US006635131B2

(12) United States Patent
Blomquist et al.

(10) Patent No.: US 6,635,131 B2
(45) Date of Patent: Oct. 21, 2003

(54) GAS GENERATING MATERIAL FOR A VEHICLE OCCUPANT PROTECTION APPARATUS

(75) Inventors: Harold R. Blomquist, Gilbert, AZ (US); Douglas P. Campbell, Metamora, OH (US); Peter Staudhammer, Mayfield Hts., OH (US)

(73) Assignees: TRW Inc., Lyndhurst, OH (US); TRW Vehicle Safety Systems Inc., Lyndhurst, OH (US)

( * ) Notice: Subject to any disclaimer, the term of this patent is extended or adjusted under 35 U.S.C. 154(b) by 132 days.

(21) Appl. No.: 09/817,593

(22) Filed: Mar. 26, 2001

(65) Prior Publication Data

US 2002/0135169 A1 Sep. 26, 2002

(51) Int. Cl.[7] ..... C06B 25/22; C06D 5/06

(52) U.S. Cl. ..... 149/99; 149/45; 149/92; 102/288; 102/289

(58) Field of Search ..... 102/288, 289; 149/45, 92, 99

(56) References Cited

U.S. PATENT DOCUMENTS

| | | | | | |
|---|---|---|---|---|---|
| 4,408,534 | A | * | 10/1983 | Araki et al. | 149/99 X |
| 4,761,250 | A | * | 8/1988 | Frankel et al. | 260/349 |
| 4,798,637 | A | * | 1/1989 | Hendrickson | 149/92 X |
| 4,878,968 | A | | 11/1989 | Willer et al. | 149/45 |
| 5,214,222 | A | | 5/1993 | Bashir-Hashemi | 568/945 |
| 5,232,526 | A | | 8/1993 | Willer et al. | 149/45 |
| 5,235,119 | A | | 8/1993 | Bashir-Hashemi | 568/945 |
| 5,241,116 | A | | 8/1993 | Bashir-Hashemi | 562/87 |
| 5,254,324 | A | | 10/1993 | Bottaro et al. | 423/263 |
| 5,378,333 | A | | 1/1995 | Bashir-Hashemi | 204/157.65 |
| 5,415,852 | A | * | 5/1995 | Schmitt et al. | 423/385 |
| 5,714,711 | A | | 2/1998 | Schumacher et al. | 102/291 |
| 5,976,483 | A | * | 11/1999 | Langlet et al. | 423/385 |
| 5,998,661 | A | | 12/1999 | Bashir-Hashemi | 562/434 |
| 6,113,713 | A | * | 9/2000 | Blomquist | 149/45 |
| 6,177,028 | B1 | * | 1/2001 | Kanda et al. | 102/289 X |
| 6,210,504 | B1 | * | 4/2001 | Thompson | 149/45 X |
| 6,222,068 | B1 | * | 4/2001 | Bashir-Hashemi | 562/498 |
| 6,289,814 | B1 | * | 9/2001 | Rink et al. | 102/289 X |

OTHER PUBLICATIONS

Eaton, Philip, et al. "Synthesis of 1,4–Dinitrocubane," J. Org. Chem., 1984, vol. 49 pp. 185–186.
Eaton, Philip, et al. "The Cuban System", J. Am. Chem. Soc., Mar. 5, 1964, vol. 86, pp. 962–964.

* cited by examiner

*Primary Examiner*—Peter A. Nelson
(74) *Attorney, Agent, or Firm*—Tarolli, Sundheim, Covell & Tummino L.L.P.

(57) ABSTRACT

An apparatus comprises a vehicle occupant protection device and a gas generating material, which, when ignited, produces gas to actuate the vehicle occupant protection device. The gas generating material comprises a cubane compound having the general formula:

wherein R is selected from the group consisting of H and $NO_2$.

8 Claims, 1 Drawing Sheet

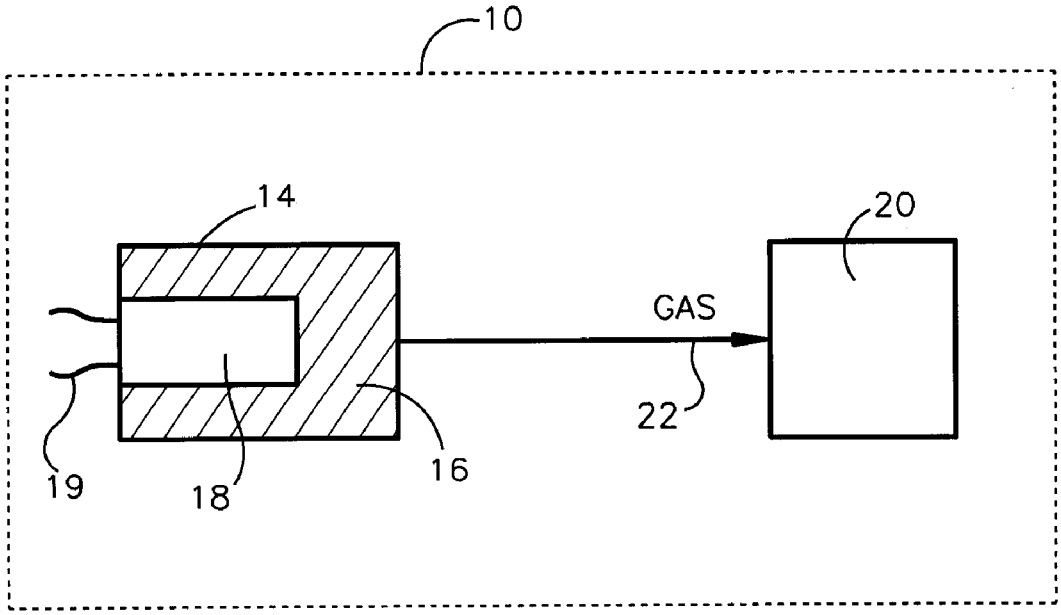
Figure

GAS GENERATING MATERIAL FOR A VEHICLE OCCUPANT PROTECTION APPARATUS

FIELD OF THE INVENTION

The present invention relates to an apparatus comprising a vehicle occupant protection device, and particularly relates to a gas generating material for providing inflation gas for inflating an inflatable vehicle occupant protection device.

BACKGROUND OF THE INVENTION

An inflator for inflating an inflatable vehicle occupant protect ion device, such as an air bag, contains an ignitable gas generating material. The inflator further includes an igniter. The igniter is actuated so as to ignite the gas generating material when the vehicle experiences a collision for which inflation of the air bag is desired. As the gas generating material burns, it generates a volume of inflation gas. The inflation gas is directed into the air bag to inflate the air bag. When the air bag is inflated, it expands into the vehicle occupant compartment and helps to protect the vehicle occupant.

It is desirable that the gas generating material for inflating an inflatable vehicle occupant protection device meet a number of technical requirements. For instance, the gas generated by combustion of the gas generating material should be substantially free of toxic materials. Moreover, the gas generated by combustion of the gas generating material should be essentially smoke-free and should have a low water content. The gas generating material must be chemically and physically stable over a wide temperature range (i.e., about −40° C. to about 110° C.), and should have ignition and combustion characteristics suitable for use in a vehicle occupant protection device.

SUMMARY OF THE INVENTION

The present invention is an apparatus that comprises a vehicle occupant protection device and a gas generating material, which, when ignited, produces gas to actuate the vehicle occupant protection device. The gas generating material comprises a cubane compound having the formula:

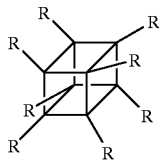

wherein R is selected from the group consisting of H and $NO_2$.

Preferably, the gas generating material further comprises an oxidizer selected from the group consisting of alkali metal nitrates, alkaline earth metal nitrates, transition metal nitrates, ammonium nitrate, alkali metal chlorates, alkaline earth metal chlorates, alkali metal perchlorates, alkaline earth metal perchlorates, ammonium perchlorate, and mixtures thereof.

BRIEF DESCRIPTION OF THE DRAWINGS

Further features of the present invention will become apparent to those skilled in the art to which the present invention relates, from consideration of the following specification, with reference to the accompanying drawing which is a schematic illustration of an apparatus embodying the present invention.

DESCRIPTION OF PREFERRED EMBODIMENTS

Referring to the Figure, an apparatus 10 embodying the present invention comprises an inflator 14. The inflator 14 contains a generating material 16. The gas generating material 16 is ignited by an igniter 18 operatively associated with the gas generating material 16. The gas generating material combusts upon ignition producing a vigorous evolution of heat and a combustion gas product. The combustion reaction moves through the gas generating material at a speed less than the speed of sound.

Electric leads 19 convey electric current to the igniter 18 and are part of an electric circuit that includes a sensor (not shown). The sensor is responsive to vehicle deceleration above a predetermined threshold. The apparatus 10 also comprises a vehicle occupant protection device 20. A gas flow means 22 conveys gas, which is generated by combustion of the gas generating material 16, to the vehicle occupant protection device 20. The gas generated by combustion of the gas generating material 16 inflates the vehicle occupant protection device 20.

A preferred vehicle occupant protection device 20 is an air bag that is inflatable to help protect a vehicle occupant in the event of a collision. Other vehicle occupant protection devices that can be used in the present invention are inflatable seat belts, inflatable knee bolsters, inflatable air bags to operate knee bolsters, inflatable head liners, and inflatable side curtains.

In accordance with the present invention, the gas generating material 16 comprises a cubane compound. The cubane compound has the following formula:

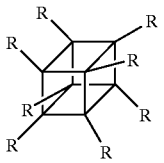

wherein R is selected from the group consisting of hydrogen (H) and a nitro functional group ($NO_2$).

A preferred cubane compound is 1,4-dinitrocubane, which has the following formula:

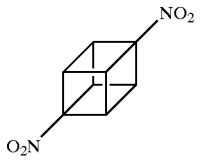

1,4dinitrocubane has a molecular weight of 194.1, a density of 1.66 g/cm$^3$, and a melting point of 260° C. 1,4-dinitrocubane also has an oxygen balance of −123.61%. By oxygen balance, it is meant the oxygen content of the 1,4-dinitrocubane relative to the total amount of oxygen required for oxidation of all of the carbon and hydrogen atoms in the 1,4-dinitrocubane to carbon dioxide and water.

1,4-dinitrocubane can be prepared by refluxing commercially available cubane-1,4-dicarboxylic acid (from Enichem Sintesi SpA. Milan, Italy) with diphenylphosphoryl azide and triethylamine in tert-butyl alcohol to form 1,4-bis[(tert-butoxycarbonyl)-amino]cubane. The 1,4-bis[(tert-butoxycarbonyl)-amino]cubane is hydrolyzed and decarboxylated to the form 1,4-diamino cubane. 1,4-diamino cubane is refluxed with m-chloroperbenzoic acid and 4,4'-thiobis(2-tert-butyl-6-methylphenol) in dichloroethane to yield 1,4-dinitrocubane.

Another preferred cubane compound is 1,3,5,7-tetranitrocubane, which has the following formula:

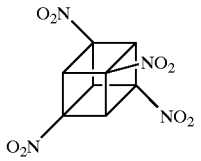

1,3,5,7-tetranitrocubane has a molecular weight of 284.1, a density of 1.81 g/cm$^3$, and a melting point of 270° C. 1,4-dinitrocubane also has an oxygen balance of −56.31%.

1,3,5,7-tetranitrocubane can be prepared by photolyzing a solution of cubane-1,4-dicarboxylic acid, oxalyl chloride, and methanol under a sunlamp to form 1,3,5,7-tetramethoxycarbonylcubane. The 1,3,5,7-tetramethoxycarbobnylcubane is refluxed with diphenylphosphoryl azide and triethylamine in tert-butyl alcohol to form 1,3,5,7-tetra[(tert-butoxycarbonyl)-amino]cubane. The 1,3,5,7-tetra[(tert-butoxycarbonyl)-amino]cubane is hydrolyzed and decarboxylated to the form 1,3,5,7-tetraamino cubane. The 1,3,5,7-tetraamino cubane is refluxed with m-chloroperbenzoic acid and 4,4'-thiobis(2-tert-butyl-6-methylphenol) in dichloroethane to yield 1,3,5,7-tetranitrocubane.

The cubane compound is incorporated in the gas generating material in the form of particles. The average particle size of the cubane compound is from about 1 $\mu$m to about 100 $\mu$m. Preferably, the average particle size of the cubane compound is from about 1 $\mu$m to about 20 $\mu$m.

The amount of the cubane compound in the gas generating material is that amount necessary to achieve sustained combustion of the gas generating material. This amount can vary depending upon the particular cubane compound and other ingredients used in the gas generating material. The amount of the cubane compound necessary to achieve sustained combustion of the gas generating material is from about 10% to about 100% by weight of the gas generating material. Preferably, the amount of the cubane compound in the gas generating material is about 15% to about 45% by weight of the gas generating material.

The gas generating material preferably includes an oxidizer. The oxidizer can be any oxidizer commonly used in a gas generating material, such as inorganic salt oxidizers. Preferred inorganic salt oxidizers that can be used in the gas generating material of the present invention are alkali metal nitrates such as sodium nitrate and potassium nitrate, alkaline earth metal nitrates such as strontium nitrate and barium nitrate, transition metal nitrates such as copper nitrate and basic copper nitrate, alkali metal perchlorates such as sodium perchlorate, potassium perchlorate, and lithium perchlorate, alkaline earth metal perchlorates, alkali metal chlorates such as potassium chlorate, alkaline earth metal chlorates, ammonium perchlorate, ammonium nitrate, or a mixture thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions to pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or an alkaline earth metal salt are ammonium perchlorate and sodium nitrate, ammonium perchlorate and potassium nitrate, and ammonium perchlorate and lithium carbonate. Ammonium perchlorate produces, upon combustion, hydrogen chloride. Non-halogen alkali metal or alkaline earth metal salts react with hydrogen chloride produced upon combustion to form an alkali metal chloride or an alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

Preferably, the oxidizer is ground into two fractions. One fraction 13 is a coarse fraction having for instance, an average particle size of about 100 to about 600 microns. The other fraction is a fine fraction having, for instance, an average particle size of about 10 to about 60 micron. The amount of the course fraction in the gas generating material is preferably in the range of about 50% to about 75% by weight, based on the weight of the oxidizer. The amount of the fine fraction in the gas generating material is preferably about 25% to about 50% by weight, based on the weight of the oxidizer.

The amount of oxidizer in the gas generating material is that amount necessary to oxygen balance the gas generating material and produce, upon combustion with the cubane compound, a combustion product that is substantially free of carbon monoxide. By substantially free of carbon monoxide, it is meant that the volume of carbon monoxide is less than about 4% by volume of gas produced upon combustion. The amount of oxidizer in the gas generating material that is necessary to oxygen balance the gas generating material is from 0 to about 90% by weight of the gas generating material. Preferably, the amount of oxidizer necessary to oxygen balance the gas generating material is about 55% to about 85% by weight of the gas generating material.

A preferred gas generating material that uses ammonium nitrate as the oxidizer includes by weight of the gas generating material 15% 1,4-dinitrocubane and 85% ammonium nitrate. This gas generating material is preferred because it produces upon combustion a particulate-free combustion product that includes, by weight of the combustion product, 32% nitrogen ($N_2$), 25% carbon dioxide ($CO_2$), and 43% water ($H_2O$). Another preferred gas generating material that uses ammonium nitrate as the oxidizer includes, by weight of the gas generating material, 74% 1,3,5,7-tetranitrocubane and 26% ammonium nitrate. This gas generating material is preferred because it produces upon combustion a particulate-free combustion product that includes, by weight of the combustion product, 32% nitrogen ($N_2$), 25% carbon dioxide ($CO_2$), and 43% water ($H_2O$).

A preferred gas generating material that uses potassium perchlorate as the oxidizer includes, by weight of the gas generating material, 73% 1,4-dinitrocubane and 27% potassium perchlorate. This gas generating material is preferred because it produces upon combustion a low particulate and low water vapor combustion product that includes by weight of the combustion product 4% nitrogen ($N_2$), 49% carbon dioxide ($CO_2$), 8% water ($H_2O$), and 39% potassium chloride (KCl). Another preferred gas generating material that uses potassium perchlorate as the oxidizer includes, by weight of the gas generating material, 55% 1,3,5,7-tetranitrocubane and 45% potassium perchlorate. This gas generating material is preferred because it produces upon combustion a low particulate and low water vapor combustion product that includes, by weight of the combustion product, 9% nitrogen ($N_2$), 56% carbon dioxide ($CO_2$), 8% water ($H_2O$), and 39% potassium chloride (KCl)

The gas generating material preferably includes a binder to adhere particles of the cubane compound as well as to adhere particles of the cubane compound with other components of the gas generating material, if utilized. A gas generating material for a vehicle occupant protection apparatus should be a resilient solid capable of withstanding shock without permanent deformation at temperatures of about 85° C. and not brittle at temperatures of about −40° C. Suitable binders that can be used to a form a gas generating material that is a resilient solid are well known in the art. Preferred binders are cellulose based binders such as cellulose acetate butyrate and nitrocellulose, polycarbonates, polyurethanes, polyesters, polyethers, polysuccinates, thermoplastic rubbers, polybutadienes, polyolefins, polystyrene, and mixtures thereof. A more preferred binder is KRATON (trademark), a polyethylene/butylene-polystyrene block copolymer manufactured by Shell Chemical Company. A preferred amount of binder is from about 0% to about 15% by weight of the gas generating material. More preferably, the amount of binder in the gas generating material is from about 2.5% to about 10% by weight of the gas generating material.

The gas generating material can include other ingredients commonly added to a gas generating material such as plasticizers, burn rate modifiers, coolants, opacifiers, and desiccants. These other components are included in the gas generating material in amounts up to about 10% by weight of the gas generating material.

Preferably, the components of the gas generating material 16 are present in a weight ratio adjusted to produce, upon combustion, a gas product that is substantially free of carbon monoxide.

The gas generating material can be prepared by mixing particles of the cubane compound and other components of the gas generating material, if utilized, in a conventional mixing device. The mixture is then compacted into the configuration of an aspirin shaped tablet or into some other desired configuration. Optionally, particles of the cubane compound and other components of the gas generating material if utilized may be mixed with a liquid in a conventional mixing device to form a liquid slurry. The liquid slurry is dried, and the dried mixture is compacted into the configuration of an aspirin shaped tablet or into some other desired configuration.

From the above description of the invention, those skilled in the art will perceive improvements, changes, and modifications. Such improvements, changes and modifications within the skill of the art are intended to be covered by the appended claims.

Having described the invention, the following is claimed:

1. An apparatus comprising a vehicle occupant protection device and a gas generating material which when ignited produces gas to actuate said vehicle occupant protection device, said gas generating material comprising an oxidizer and a cubane compound having the general formula:

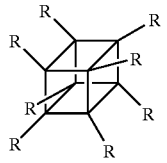

wherein at least one R is $NO_2$, the remaining Rs being selected from the group consisting of H and $NO_2$.

2. An apparatus comprising an inflatable vehicle occupant protection device and a gas generating material which when ignited produces gas to inflate said inflatable vehicle occupant protection device, said gas generating material comprising by weight of the gas generating material about 15% to about 45% of a cubane compound having the general formula:

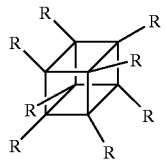

wherein at least one R is $NO_2$, the remaining Rs being selected from the group consisting of H and $NO_2$ and about 55% to about 85% of an oxidizer.

3. The apparatus as defined in claim 1 wherein the oxidizer is selected from the group consisting of alkali metal nitrates, alkaline earth metal nitrates, transition metal nitrates, ammonium nitrate, alkali metal chlorates, alkaline earth metal chlorates, alkali metal perchlorates, alkaline earth metal perchlorates, ammonium perchlorate, and mixtures thereof.

4. The apparatus as defined in claim 1 wherein said cubane compound comprises 1,4-dinitrocubane or 1,3,5,7-tetranitrocubane.

5. The apparatus of claim 1 wherein the amount of oxidizer in the gas generating material is that amount of oxidizer necessary to oxygen balance the gas generating material and produce, upon combustion with the cubane compound, a combustion product that is substantially free of carbon monoxide.

6. The apparatus as defined in claim 1 wherein the gas generating material further comprises a binder.

7. The apparatus as defined in claim 2 wherein the oxidizer is selected from the group consisting of alkali metal nitrates, alkaline earth metal nitrates, transition metal nitrates, ammonium nitrate, alkali metal chlorates, alkaline earth metal chlorates, alkali metal perchlorates, alkaline earth metal perchlorates, ammonium perchlorate, and mixtures thereof.

8. The apparatus as defined in claim 7 wherein said cubane compound comprises 1,4-dinitrocubane or 1,3,5,7-tetranitrocubane.

* * * * *